United States Patent [19]

Klayman

[11] Patent Number: 4,841,572

[45] Date of Patent: Jun. 20, 1989

[54] STEREO SYNTHESIZER

[75] Inventor: Arnold I. Klayman, Huntington Beach, Calif.

[73] Assignee: Hughes Aircraft Company, Los Angeles, Calif.

[21] Appl. No.: 167,615

[22] Filed: Mar. 14, 1988

[51] Int. Cl.[4] ..... H04S 1/00

[52] U.S. Cl. ..... 381/17; 381/1

[58] Field of Search ..... 381/1, 17

[56] References Cited

U.S. PATENT DOCUMENTS

| | | | |
|---|---|---|---|
| 3,541,266 | 11/1970 | Klayman et al. . | |
| 4,239,939 | 12/1980 | Griffis . | |
| 4,394,535 | 7/1983 | Bingham et al. . | |
| 4,479,235 | 10/1984 | Griffis . | |
| 4,489,432 | 12/1984 | Polk . | |
| 4,496,979 | 1/1985 | Yu et al. . | |
| 4,555,795 | 11/1985 | Bedini . | |
| 4,594,610 | 6/1986 | Patel . | |
| 4,594,730 | 6/1986 | Rosen . | |
| 4,625,326 | 11/1986 | Kitzen et al. . | |
| 4,633,495 | 12/1986 | Shotz . | |
| 4,685,134 | 8/1987 | Wine . | |
| 4,706,287 | 11/1987 | Blackmer et al. | 381/17 |
| 4,748,669 | 5/1988 | Klayman | 381/1 |

FOREIGN PATENT DOCUMENTS 097982 1/1984 European Pat. Off. .

OTHER PUBLICATIONS

Dickey, "Outputs of Op-Amp Networks have fixed phase difference", pp. 129, 130 of Designers Casebook.

*Primary Examiner*—Forester W. Isen

*Attorney, Agent, or Firm*—Joseph E. Szabo; Anthony W. Karambelas

[57] ABSTRACT

A stereo image enhancement system, in which difference signal components in relatively quieter difference signal frequency bands are boosted to provide an improved stereo image, is provided with a stereo input that is synthetically derived from monaural signal (L+R). Simulated sum $(L+R)_S$ and simulated difference $(L-R)_S$ signals are provided from a monaural input (L+R) by sending the input through a phase shifter and splitter (12) that provides 0° and 90° outputs with a constant 90° phase separation between the two at all audio frequencies. The leading one of the two output signals from the phase shifter is employed as a simulated sum signal, and the other as a simulated difference signal. The simulated difference signal has different frequency components, each delayed by different amounts relative to corresponding components of like frequency of the simulated sum signal. This provides an effective synthetic difference signal, with both sum and difference signals being suitably filtered to provide an improved pair of synthetically derived stereo sum and difference signals $(L+R)_S$, $(L-R)_S$ as inputs to an image enhancement circuit.

19 Claims, 3 Drawing Sheets

MIXER
162
LOUT
164
LIN
166
(L+R)P
(L-R)P
GAIN CONTROLLED AMP
146
SUM EQUALIZER
142
DIFF. EQUALIZER
144
CONTROL
148
FROM SENSOR 170
S3
158
S4
160
SUM
150
LIN
154
DIFF.
152
RIN
156
L-R SENSOR
170
S1
138
S2
140
(L+R)S
(L-R)S
F1
110
F2
112
0°
-90°
CONSTANT φ SHIFT
12
INPUT
134
L+R
L-R
136
RECEIVER
132
BROADCAST
130
L-R
L+R

RECEIVER-RADIO, TV PLAYBACK OR OTHER DEVICE
200
L
202
R
204
208
210
CONSTANT φ SHIFT
12
(L+R)S
14
(L-R)S
16

STEREO SYNTHESIZER

This application is related to my co-pending application for Stereo Enhancement System, Ser. No. 929,452, filed Nov. 12, 1986. The disclosure of such application is incorporated in the present application by this reference as though completely set forth herein.

BACKGROUND OF THE INVENTION

1. Field of the Invention

The present invention is an improvement on the stereo enhancement system of my prior application, Ser. No. 929,452, filed Nov. 12, 1986, and enables my prior invention to be used with a monaural input signal. The present invention relates to an improved feature of the generation of synthetic stereo signals from a monaural signal and more particularly relates to synthetic generation of sum and difference stereo signals of a type which provide useful stereo information to a stereo enhancement system.

2. Description of Related Art

In many stereo sound systems the circuits merely amplify right and left channel signals and feed these to loudspeakers. In my above-identified co-pending application, stereo signals such as sum and difference signals are processed to provide image enhanced stereo output signals to a stereo speaker system. In these systems and other stereo systems it is necessary that a stereo input be provided if a stereo output is to be produced. Generally such a stereo input is available either in the form of left and right stereo input signals, or, as in some broadcast systems, in the form of the sum (L+R) of left and right stereo signals and the difference (L−R) between such left and right stereo signals. In a common type of stereo signal broadcast system, left and right stereo signals are combined at the broadcast station before transmission. A sum signal (L+R) is modulated upon a main carrier, and a difference signal (L−R) is modulated upon a higher frequency sub-carrier. Generally the sub-carrier is weaker than the main carrier, and transmission of the stereo signals is frequently along multiple paths due to the bouncing of the FM transmission between or among buildings or other obstacles. This causes the difference signal transmitted on the weaker sub-carrier to be considerably weaker at a receiving station, varying in intensity, and fading in and out according to location of the receiver. When such a receiver is mounted in a moving vehicle, it may occur that the difference signal received is so weak as to be substantially useless. For such conditions some receivers are arranged to ignore the weak difference signal and to receive, process and transduce through its loudspeakers solely a monaural signal in the form of the sum (L+R).

Therefore, where the difference signal is too weak or absent, the listener will only be able to receive and hear a monaural sound. This is so even if the receiver should include effective and sophisticated stereo image enhancement circuitry, such as described in detail in my above identified co-pending application. Only in the presence of a stereo input will certain image processing circuits, such as the stereo enhancement system of my prior application, be able to perform the desired enhancement In other situations only a monaural signal is produced, but stereo sound is desired. For example, when playing a monaural record in a stereo playback system, it would be desirable to provide both left and right stereo signals to the system amplifier, whether or not any enhancement circuitry is employed. So, too, when a vocalist or individual instrumentalist provides sound to only a single microphone, it may be desired to provide stereo sound from the single monaural signal.

Therefore it is desirable to enable a receiver, a playback system, a recording system, or any other sound system, to provide stereo sound even though but a single signal, a monaural signal, is available.

Accordingly, it is an object of the present invention to provide a stereo image enhancement system capable of use with a monaural input.

SUMMARY OF THE INVENTION

In carrying out principles of the present invention, in accordance with a preferred embodiment thereof, stereo output signals are generated from an input signal by producing simulated or synthetic sum and difference signals in response to the input signal. The synthetic difference signal is delayed with respect to the synthetic sum signal and has components of different frequencies, each having a different time delay relative to components of like frequency of the synthetic sum signal. The synthetic sum and difference signals are fed as stereo inputs to a stereo image enhancement circuit According to a feature of the invention, the simulated difference signal is provided by shifting the phase of the input signal with a phase shift that is constant over a broad frequency range so that the simulated difference signal lags the input signal and different frequency components of the simulated signals have different amounts of delay.

According to another feature of the invention, stereo output signals are generated from an input signal by employing the input signal to produce simulated sum and difference signals and feeding the simulated signals to stereo image enhancement means. The stereo image enhancement means is arranged to selectively alter relative amplitudes of components of the simulated difference signal within respective predetermined frequency bands so as to boost difference signal components in relatively quieter difference signal frequency bands and to selectively attenuate relative amplitudes of components of the sum signal within said quieter difference signal frequency bands.

DESCRIPTION OF THE PREFERRED EMBODIMENT

Figure 1:
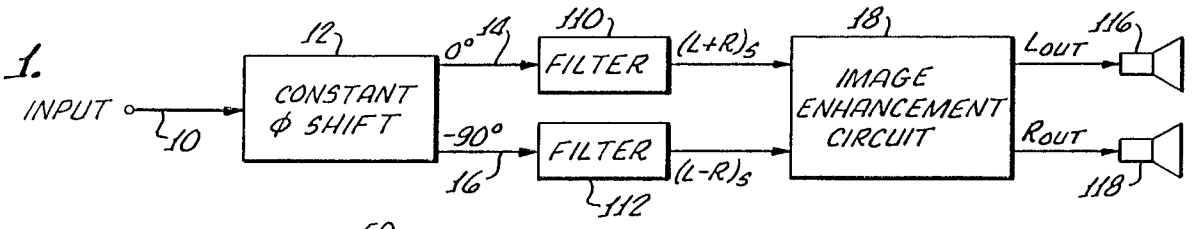
FIG. 1 is a simplified block diagram of a system embodying principles of the present invention.

As illustrated in FIG. 1, an input signal on a line 10 is fed to a constant phase shift circuit 12 having certain desired characteristics. This phase shift circuit provides a pair of outputs on lines 14,16 respectively, which exhibit a 90° phase difference with respect to one another. Therefore, the signal on line 14 may be labeled 0°, and that on line 16 may be labeled −90°, solely to identify the phase of the signal on line 14 relative to phase of the signal on line 16. Neither of the signals on lines 14 and 16 is necessarily related to the input on line 10 by either 0° or 90°. The phase relation of the circuit outputs to the input is not important. Only relative phase of the two circuit outputs must be controlled. Characteristics of the constant phase shift circuit 12 are such that a substantially constant 90° phase separation between signals on line 14 and the signal on line 16 exists at all frequencies over the audio band. That is, between the frequencies of about 100 Hertz and 15 Kilohertz all frequencies of outputs on lines 14 and 16 have a substantially 0° phase difference. Amplitude response is relatively flat at all such frequencies. Accordingly, since the phase separation is relatively constant over all frequencies, it follows that the time delay of any one frequency of the signal on line 16 with respect to any second frequency of the signal on line 16 will be different than the time delay of such one frequency with respect to a third frequency. In other words, the several frequency components of the signal on line 16 each has a different time delay relative to the other frequency components of this signal so that the several frequency components of the synthetic difference signal on line 16 are effectively spread out in time. The same is true for the simulated sum signal on line 14. Thus there is a different time delay between corresponding frequency components of the simulated signals at different frequencies. The time delays of the several components vary with the frequencies of such components.

Importantly, the several frequency components of the synthetic difference signal are delayed by different amounts relative to components of corresponding frequencies of the synthetic sum signal. For example, the time delay of a synthetic difference signal component of 1000 Hertz relative to a synthetic sum signal of 1000 Hertz is greater than the time delay of a synthetic difference signal component of 2000 Hertz relative to a synthetic sum signal component of 2000 Hertz. Therefore, this time spreading of frequency components provides an effective simulation of a stereo difference signal. The entire signal, that is, all the frequencies of the signal on line 16, will lag all corresponding frequencies of the signal on line 14 by about 90°.

With the described outputs of the constant phase shifter 12, the signal on line 14 may be considered to be the stereo sum signal (L+R), and the signal on line 16 may be considered to be a stereo difference signal (L−R). Because both outputs have been phase shifted (as will be described below), both may be termed synthetic, and are labeled $(L+R)_s$ and $(L-R)_s$ in the drawings (after being filtered). However, the phase shifting (or any other processing) of the sum signal on line 14 is not necessary, except as needed to obtain the desired lagging phase relation of the synthetic difference signal on line 16. These synthetic sum and difference signals provide stereo information by virtue of the fact that the 0°, or sum signal, on line 14 leads the −90°, or simulated difference signal, on line 16. Therefore the sum signal is heard before the difference signal. This relation serves to emphasize (to the human ear) the central localization of center stage performers, such as soloists or vocalists. Different difference signal frequency components are spaced from their corresponding frequency components of the synthetic sum signal by different increments of time which depend upon frequencies of the several components. Because the different frequency components of the simulated difference signal $(L-R)_s$ have different delays relative to corresponding frequency components of the simulated sum signal $(L+R)_s$, there is created, for the listener, an illusion of a spread out sound stage. This is an effective synthesis of stereo sound.

The difference signal on line 16 is truly different from the sum signal on line 14, and thus the two signals may be processed by the stereo image enhancement circuit 18 in the manner to be described below.

Although positional information is not preserved in the signal on line 14, the described synthetic signal generation circuit creates an illusion of signal spread and ambience (by the simulated difference signal), and at the same time maintains an illusion of a soloist or vocalist at center stage (by the sum signal on line 14).

Circuits for maintaining a substantially constant phase shift and flat amplitude response over the audible hearing range, such as between 100 Hertz and 15 Kilohertz, are well known and several different circuits of this type may be employed in the practice of the present invention. For example, such a circuit is shown in U.S. Pat. No. 3,541,266 for Banwidth Compressor and Expander and in an article entitled "Outputs of op-amp networks have fixed phase difference" by Richard K. Dickey in pages 129, 130 of the Designers Casebook, Edited by Electronics and published by McGraw Hill.

Figure 2:
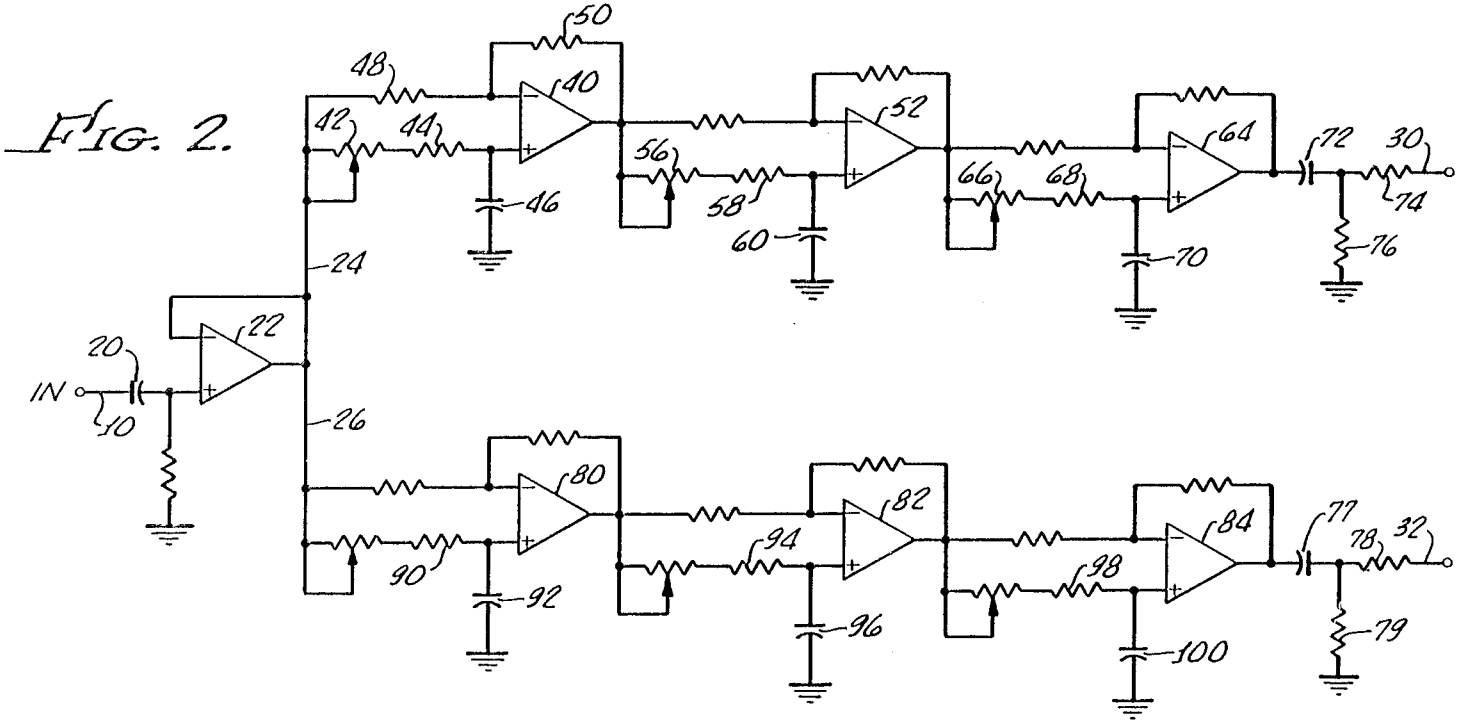
FIG. 2 is a circuit diagram of an exemplary constant phase shift circuit.

FIG. 2 illustrates an exemplary constant phase shift circuit that has been used in the present invention. In this circuit a monaural input signal on line 10 is fed via an input capacitor 20 and a voltage following differential amplifier 22 to first and second phase shift channels having inputs on lines 24 and 26 respectively from the output of the voltage following amplifier 22. Each of the channels of the phase shifter, the upper (first) channel, and the lower (second) channel, effectively provide a phase shift of the output of amplifier 22 that is substantially constant over the desired frequency band. The output of the upper channel at an output terminal 30 has some predetermined phase relation with respect to the input signal on line 10. Moreover, the output of the lower channel on terminal 32 also has a predetermined phase relation with respect to the input signal on line 10, but, in addition, has a fixed 90° lagging phase relation with respect to the output signal of the upper channel at terminal 30. This 90° lagging phase relation is substantially constant over the frequency band of interest.

Referring now to the upper channel of FIG. 2, the input signal is fed to a first differential amplifier 40, being fed to its non-inverting input via an adjustable resistor 42 and an RC network 44,46 having a selected time constant. The same input signal on line 24 is also fed via a fixed resistor 48 to the inverting input of the amplifier to which the amplifier output is fed back via a fixed resistor 50. The circuitry connected directly with the differential amplifier 40 provides a 90° phase-shift over a relatively narrow frequency band, such as, for example, 50 to 500 Hertz, with a 90° shift occurring substantially at the musical center (about 200 Hertz) of this frequency band. The output of the first phase shift stage is fed to the inputs of a second phase shift stage comprising a second differential amplifier 52, having its output fed back to its inverting input via a fixed resistor and having the input signal fed to its inverting input via a second fixed resistor. The non-inverting input of the amplifier 52 receives the output signal of the preceding stage via a variable resistor 56 and an RC network 58,60 to provide from this stage a phase shift of 90° substantially at the center (about 1675 Hertz) of a second frequency band having a band width from about 1,000 to 5,000 Hertz.

A third stage of phase shift over a bandwidth of about 5 Kilohertz to 50 Kilohertz provides a 90° phase shift substantially at the center (about 20 Kilohertz) of this band. This third stage is provided by a third differential amplifier 64 having the output of the preceding stage fed through a fixed resistor to its inverting input, to which the amplifier output is fed back by a similar fixed resistor. The preceding stage input is also fed to the non-inverting input of amplifier 64 via a variable resistor 66 and an RC circuit 68,70.

Output of the final stage is fed through a capacitor 72 and via a resistor 74 to an output terminal 30.

The RC circuits connected to the non-inverting inputs of the several amplifiers are the circuit components which primarily determine the amount of phase shift and the frequency band of operation of the individual stages. Thus the values of these RC circuit components primarily determine the phase characteristics of the resultant output. In an exemplary embodiment resistors 44,58 and 68 are 36 Kilohms, 18 Kilohms and 10 Kilohms, respectively. Capacitors 46, 60 and 70 are 0.02 microfarads, 0.005 microfarads, and 0.0005 microfarads, respectively. The variable resistors are each 5 Kilohms.

It will be readily appreciated that the ideal of a perfectly constant phase shift over the entire frequency range of 100 Hertz to 15 or more Kilohertz is only approximately achieved by breaking the frequency band of interest into three separate bands and employing different phase shifting circuits for operation in each of such of such bands. Thus within each of such bands the phase shift provided by the particular stage is not constant over the bandwidth of the individual band (being 90° at the musical center of the band), but the approximation of the totality of three separate stages distributed over the entire frequency band as described above is adequate to provide what may be effectively termed a phase shift that is constant over the entire frequency band. If more precise adherence to a constant phse shift over the frequency band is desired, this may be achieved merely by increasing the number of individual stages and narrowing the frequency bands.

The lower channel of the phase shifter is identical to the upper channel except for a different choice of component values, which provides the 90° lag of the output of this channel relative to the output of the upper channel. Thus the lower channel also has three stages, including differential amplifiers 80,82 and 84, each receiving an input to its inverting input via a fixed resistance and a fixed feedback resistor from the output of the preceding stage, or, in the case of amplifier 80, from the input signal itself. Each of the amplifiers also receives an input to its non-inverting input via a variable resistance and an RC network. The several RC networks are identified as including resistor 90 and capacitor 92 for amplifier 80, resistor 94 and capacitor 96 for amplifier 82, and resistor 98 and capacitor 100 for amplifier 84. As with the upper channel, the values of these RC circuit components are selected to provide for a 90° phase shift centered in predetermined frequency bands. Thus the first stage, including amplifier 80, is set to provide a 90° phase shift centered at about 50 Hertz (e.g. being exactly 90° at 50 Hertz) over a frequency band of about 20 to 200 Hertz. The second stage, including amplifier 82, is set to provide a substantially constant phase shift centered at (e.g. being 90° at) 600 Hertz over a frequency range of between about 200 and 2,000 Hertz, and the third stage, including amplifier 84, is set to provide a substantially constant phase shift centered at (e.g. being 90° at) about 5,000 Hertz over a band from about 2,000 to 20,000 Hertz. To obtain this operation, resistors 90, 94 and 98 are 30, 24 and 15 Kilohms respectively, and capacitors 92, 96 and 100 have values of 0.1, 0.01, and 0.002 microfarads respectively. All resistors connected to the inverting inputs of all amplifiers of both channels are 100 Kilohms. Each variable resistor is 5 Kilohms. The output capacitor 72 and resistors 74,76 of the upper channel are 4.7 microfarads, 560 ohms, and 4.3 kilohms, respectively. The output capacitor 77 and resistors 78 and 79 are 4.7 microfarads, 560 ohms and 1 kilohm, respectively.

Referring back to FIG. 1, the signal on line 14 and the lagging signal on line 16 are fed to first and second filters 110,112 at the output of which are provided the synthetic sum signal $(L+R)_s$ and the synthetic difference signal $(L-R)_s$. The phase shifting of the input signal on line 10 is not required for the provision of adequate stereo. It is only necessary that the synthetic difference signal have the described phase relation to the signal representing the sum signal and also have the delays that vary with frequency. Any circuit providing this relation between sum and synthetic difference signal may be used. It is found most convenient to obtain the relation between synthetic difference signal and sum signal by using the described circuit which obtains the desired phase relation and time delays of different frequency components of the synthetic difference signal by operating on both channels. Therefore, the processing of the input signal by the upper channel is employed solely to obtain the desired relation between the two outputs. The signal on line 14 may be considered to be the input signal (on line 10), or its equivalent, while the synthetic difference signal has the desired phase lagging relation.

Figure 3:
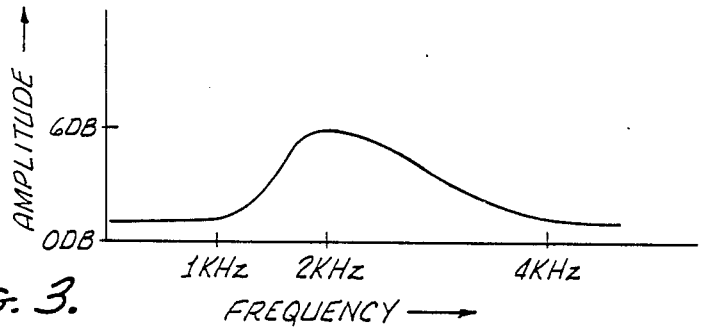
FIGS. 3 and 4 illustrate characteristics of optional filters for use in connection with a phase shift circuit of FIG. 2.

Filters 110 and 112 are provided for the purpose of still further improving the synthetic stereo signals. In some cases, one or the other or both of these filters may be eliminated if desired. Filter 110 provides a band pass in the band between about 1,000 Hertz and 4 Kilohertz, having a peak relative amplitude boost of approximately 2 to 6 dB at about 2 Kilohertz. A curve illustrating an exemplary characteristic desired of filter 110 is illustrated in FIG. 3, showing relative amplitude boost of about 6 dB at about 2 Kilohertz, falling to substantially no boost at 1 and 4 Kilohertz respectively. Filter 110 helps to enhance the illusion of the source of the $(L+R)_s$ signal at the filter output as being located at center stage.

Figure 4:
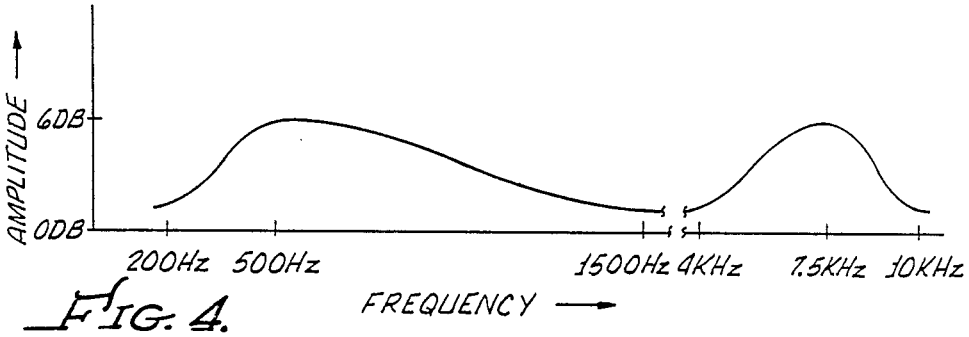

Filter 112, operable upon the synthetic difference signal, provides a relative boost in low and high bands. The filter provides a relative boost of up to 6 dB at about 500 Hertz, falling off to about 2 dB boost at about 200 Hertz and 1500 Hertz, as illustrated in FIG. 4. This filter also provides a second relative boost of about 6 dB over the band of about 4 Kilohertz to about 10 Kilohertz, centered at about 7.5 Kilohertz and falling off to about 2 dB boost at about 4 Kilohertz and 10 Kilohertz. Filter 112 thus helps to provide the illusion of a spread of sound by providing relative boosts at both lower and higher bands, but not in the center bands. In effect, filters 110 and 112 provide frequency contouring for the synthetically generated sum and difference signals so as to emphasize physiological hearing characteristics with respect to azimuth. Use of these filters will depend upon placement of the speakers with respect to the listener. The center location filter 110 is preferred to help the listener have the illusion of a front or center stage sound. Use of this filter is preferred when using only side mounted speakers, such as earphones. If a listener is using only front mounted speakers, the spreading characteristics of the illusion provided by filter 112 are more desirable For a listener positioned with speakers on lines directed laterally outwardly and forwardly at 45° on either side of the listener, use of both filters 110 and 112 is desired.

Thus, the two filters provide the synthetic sum signal $(L+R)_s$ (which is effectively the monaural input signal) and the synthetic difference signal $(L-R)_s$, with the latter being delayed with respect to the former and also having different frequency components thereof delayed by different amounts relative to corresponding frequency components of $(L+R)_s$. These sum and difference signals are fed to the image enhancement circuit 18, which may be identical to the circuitry shown in my co-pending application, identified above, and which provides left and right output signals ($L_{out}$ and $R_{out}$) to left and right stereo speakers 116,118, all as described in detail in my prior co-pending application.

Figures 5, 7:
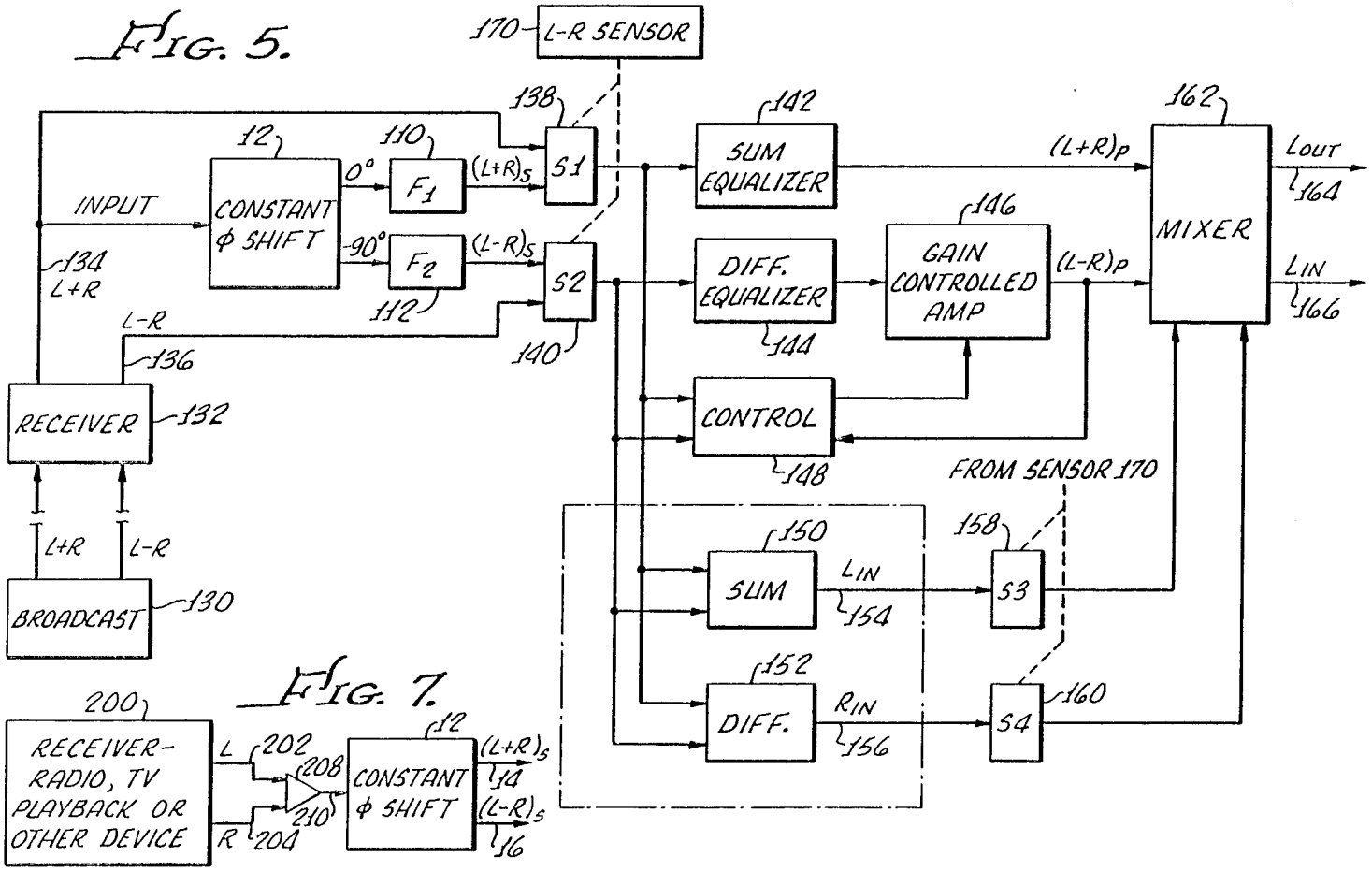
FIG. 5 is a block diagram showing additional details of the system of FIG. 1 as used with a radio receiver.
FIG. 7 illustrates another use of the system of FIG. 1.

FIG. 5 shows an application of the system of FIG. 1 to received stereo broadcast signals and also shows additional detail of the enhancement circuit, together with the interconnection of the receiver, synthetic signal generator and enhancement circuit.

A broadcast station 130 sends stereo signals in the form of a sum signal (L+R) and a difference signal (L−R) modulated upon a carrier and sub-carrier, respectively, to a receiver 132, which provides signals (L+R) and (L−R) on lines 134,136. The received signals are fed via switching or variable gain devices 138,140 to a stereo image enhancement circuit of the type set forth in full detail in my above-identified co-pending patent application. In general the enhancement circuit includes a sum equalizer 142 and a difference equalizer 144. The difference equalizer 144, either statically or dynamically, selectively alters relative amplitudes of components of the difference signal within respective predetermined frequency bands so as to boost these difference signal components that are in relatively quieter difference signal frequency bands (e.g. those frequency bands of a real stereo difference signal in which amplitudes are relatively lower, as statistically determined). The quieter difference signal frequency bands are determined either statistically (for static equalization) or by sensing circuits (for dynamic equalization). For use with a synthetic difference signal, static equalization is preferred. The sum signal equalizer selectively alters relative amplitudes of components of the sum signal within the same frequency bands (e.g. those in which the difference signal is relatively quieter) but relatively attenuates these. The difference signal, as equalized by equalizer 144, is fed through a gain controlled amplifier 146, of which the gain is controlled by a control circuit 148, having inputs from the sum and difference signals at the output of switches 138 and 140. The control circuit 148 also has a feedback from the processed difference signal $(L-R)_p$ provided at the output of gain control amplifier 146.

The effect of the control circuit and gain control amplifier, as described in detail in my prior co-pending application, is to effectively maintain a fixed ratio between amplitudes of the processed difference signal $(L-R)_p$ and the unprocessed sum signal (L+R). By this means the image enhancement circuit compensates for different amounts of stereo in different recordings and for different amounts of stereo from one point to another within a single recording, all as described in my prior copending application.

Sum and difference signals (L+R) and (L−R) are made up of the sum of left and right stereo signals L and R. If such left and right stereo input signals are not available, the image enhancement circuit can readily produce these from the sum and difference signals by taking the sum and difference of the sum (L+R) and difference (L−R) signals in sum and difference circuits 150,152 to provide reconstituted input left and right stereo signals in the form of Lin and Rin on lines 154,156 respectively. The signals on lines 154,156 are fed through switches 158,160 to a mixer 162 of the image enhancement circuit. The mixer receives the processed sum signal $(L+R)_p$ and processed difference signal $(L-R)_p$ together with the left and right input signals $L_{in}$ and $R_{in}$ and combines these to provide stereo output signals Lout and $R_{out}$ on output lines 164,166 which are fed to left and right speaker systems (not shown in FIG. 5). Switches 158,160 are ganged with switches 138,140 so that the sum and difference circuits 150,152 are effective to provide signals to the mixer only when real stereo signals are available. If receiver 132 itself processes the received sum and differences signals to provide $L_{in}$ and $R_{in}$ directly from the receiver, the sum and difference circuit 150,152 need not be used and the signals $L_{in}$, $R_{in}$ may be fed directly from the receiver through switches 158,160 to the mixer 162.

The system operates as described above and as described in my co-pending application when both broadcast signals (L+R) and (L−R) are of adequate strength. The described circuit, however, also includes the constant phase shift circuit 12, identical structurally and functionally to the similar circuit of FIG. 1, together with its filters 110 and 112 to provide synthetic $(L+R)_s$ and $(L-R)_s$ signals, which are also fed as second or alternative inputs to the respective switching devices S1 and S2, indicated at 138 and 140 respectively. The received sum signal (L+R) is fed as the input to the constant phase shift circuit.

If the broadcast sum and difference signals (L+R) and (L−R) are of adequate strength, the synthetic stereo generating circuit, including phase shifter 12 and filters 110 and 112, are effectively disabled. The switches 138 and 140 remain in a position in which only the broadcast signals (L+R) and (L−R) are passed to the stereo image enhancement circuit. Similarly switches 158,160 pass $L_{in}$ and $R_{in}$ to the mixer 162. On the other hand, should the signal (L−R) become too weak to be of use, the broadcast signals (L+R) and (L−R) are not fed to the image enhancement circuit. On the contrary, instead of the broadcast signals, only the synthetic signals $(L+R)_s$ and $(L-R)_s$ from filters 110,112 are fed to the stereo image enhancement circuit. Switches 158,160 are open to block transmission of $L_{in}$ and $R_{in}$ from circuits 150,152. The selection is accomplished by a sensor 170 which may be included in the receiver 132 to sense the strength of the difference signal (L−R). The arrangement is such that the (L−R) sensor provides a switching signal when the broadcast difference signal falls below a selected threshold value.

The switching signal from the sensor is caused to operate both switching means 138 and 140 to block passage of the broadcast signals (L+R) and (L−R) and to enable passage of the synthetic signals $(L+R)_s$ and $(L-R)_s$ to the sum and difference equalizers respectively. The switching signal also operates switches 158,160 so that the mixer receives no $L_{in}$ and $R_{in}$ signal when the synthetic signals $(L+R)_s$ and $(L-R)_s$ are fed to the equalizers. If deemed necessary or desirable, the simple, two position switching devices 138,140 may be changed to be a group of four gain control amplifiers, each responsive to one of the broadcast and synthetic signals. The sensor provides an output signal having an amplitude proportional to the strength of the received (L−R) signal. The gain control amplifiers of the broadcast signals are operated (from the sensor output) inversely with respect to operation of the gain control amplifiers of the synthetic signals. The outputs of the two sets of gain control amplifiers are summed before transmission to the stereo image enhancement circuit. In such an arrangement for the difference signal, for example, the synthetic and the broadcast difference signal are mixed in relative proportions according to strength of the received difference signal. Thus a greater proportion of broadcast difference signal is mixed with a lesser proportion of synthetic difference signal when the broadcast signal is stronger, and visa versa. Similarly, the broadcast sum and synthetic sum signals are mixed in different proportions according to the strength of the sensed difference signal. In this arrangement the switches 158,160 are replaced with attenuators which attenuate $L_{in}$ and $R_{in}$ in proportion to the sensed decrease in strength of received (L−R).

In several of the embodiments disclosed in the above-identified co-pending application mixer 162 mixes various signals including processed sum and difference signals and both left and right input signals. Thus the ( 5 mixer operates according to the following equations:

$$L_{out}=L_{in}+K_1(L+R)_p+K_2(L-R)_p \quad \text{EQ (1)}$$

$$R_{out}=R_{in}+K_1(L+R)_p-K_2(L-R)_p \quad \text{EQ (2)}$$

Where $K_1$ and $K_2$ are constants. Since $-K_2(L-R)_p$ is the same as $+K_2(R-L)_p$, the mixer effectively inverts $(L-R)_p$ to obtain $(R-L)_p$. When using the synthetic signals, the mixer operates solely upon the processed sum and difference signals, in which case no left and right input signals to mixer 162 from lines 154 and 156 are fed to the mixer.

In the stereo image enhancement circuit of my co-pending application difference signal components (L−R) of one phase are fed to the left speaker and are caused to become significant components of the left stereo output signal $L_{out}$ (see EQ(1)). Equation (2) may be written as:

$$R_{out}=R_{in}+K_1(L+R)_p+K_2(-L)_p \quad \text{EQ(3)}$$

The equations state that difference signal components (R−L) of opposite phase relative to the (L−R) components are fed to the right speaker and caused to become material components of the right output stereo signal $R_{out}$ (see EQ(2)). Thus difference signals of one phase (L−R) are heard from the left speaker, and difference signals of opposite phase (R−L) are heard from the right speaker. This effect is employed in the arrangement of FIG. 6, which provides an example of one manner of employing the described synthetic stereo circuitry to arbitrarily assign instruments or sounds in various frequency ranges to broadly discrete apparent locations. The described example illustrates how it may be possible, utilizing this system, to position (as sensed by the listener) lower pitched instruments (actually sounds having lower frequencies) on the apparent right side of the stage and higher pitched instruments (actually sounds having higher frequencies) on the left side of the stage. In this arrangement the input signal on line 10 is fed to phase shifter 12, identical to the phase shifter previously described, which provides a 0° output on line 14 to the first filter 110 at the output of which appears the synthetic sum signal $(L+R)_s$. The 90° lagging signal on line 16 is fed to the input of a high pass filter 180 and also to the input of a low pass filter 182 of which the outputs are summed in a summing network 184 after inverting the output of filter 180 in an inverter 186. Thus this system effectively maintains the phase of the low frequency .signals passed by low pass filter 182 with unchanged phase relation with respect to the synthetic difference signal as it exists when the synthetic sum and difference signals are produced at the output of phase shifter 12. On the other hand, the system inverts the phase of the higher frequency signals passed by filter 180 to provide these with an opposite phase relative to that which they had at the output of phase shifter 12. Thus, when combined, the two signals components, namely the low frequency components from filter 182 having unchanged phase, and the higher frequency components from filter 180 having an inverted phase, will be passed through the filter 112 to provide the synthetic difference signal $(L-R)_s$. Because of the opposite phase provided by the inversion circuit 186, lower frequency components of the synthetic difference signal now appear to emanate from one side of the stage, whereas the higher frequency components of the synthetic difference signal now appear to emanate from the other side.

Figure 6:
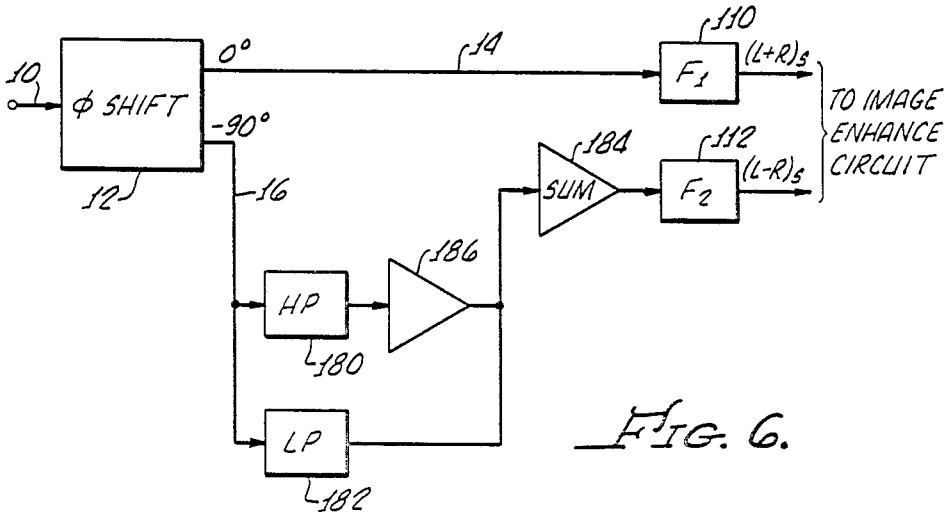
FIG. 6 is a simplified block diagram of a modification of the circuit of FIG. 1.

This technique, as illustrated in the example of FIG. 6, may be accomplished with more complexity and sophistication by dividing the frequency spectrum into more than just two sections, using selective bandpass as well as high pass and low pass filters and inverting outputs or outputs of only some of the filters, to selectively place (to the apparent hearing of the listener) different frequency bands on one or the other side of the apparent stage. By mixing various proportions of inverted and non-inverted signals in the summing amplifier, these particular frequency bands may be placed at different positions across the apparent stereo stage.

In FIG. 1, the monaural input may be provided from any type of device, system or instrument that produces a monaural signal in circumstances where it is desired to be able to produce a stereo output. For example, to provide a stereo sound from a soloist, vocal or instrument player, sound may be sensed by a single microphone and fed to the described synthetic stereo circuits (to phase shift circuit 12).

Further, where a system such as a stereo broadcast receiver or playback device such as a record or tape player, or the like, is either receiving or playing a monaural signal or recording, stereo sound may be produced as shown in FIG. 7. Such a receiver or playback device 200 is designed to receive a stereo broadcast or to play a stereo record an produce left and right stereo output signals on lines 202,204. If the device receives only a monaural signal, or plays a monaural record or tape, the same monaural signal is provided on both of its output lines 202,204. Thus, to provide synthetic stereo from the two identical monaural signals, the latter are fed to a summing amplifier 208 which provides on its output line 210 a single monaural signal as the signal input to the phase shifter 12 of FIG. 1.

The described systems, accordingly, illustrate some typical applications of the synthetic stereo circuit disclosed herein.

What is claimed is:

1. A system for generating stereo image enhanced output signals from a monaural input signal having a bandwidth, said system comprising:

first means responsive to the monaural input signal for generating a simulated sum signal which comprises different frequencies, second means responsive to the input signal for generating a simulated difference signal that is delayed with respect to said simulated sum signal and which has components of said different frequencies, each such component in said second means having a different time delay with respect to a corresponding component in said first means, each said first and second means comprising phase shift means for providing each different delay time as a substantially fixed phase separation between corresponding bands of said simulated sum and said simulated difference signals over a portion of said bandwidth of frequencies.

stereo image enhancement means responsive to said simulated sum and difference signals for generating stereo enhanced left and right output signals.

2. The system of claim 1 wherein said means for generating a simulated difference signal comprises means for shifting the phase of said input signal with a phase shift that is constant over a broad frequency range so that said simulated difference signal lags the simulated sum signal and so that different frequency components of said simulated difference signal lag corresponding frequency components of said simulated sum signal by different amounts.

3. The system of claim 1 wherein different frequency components of said simulated difference signal have delays relative to corresponding frequency components of said simulated sum signal that are proportional to the frequencies of such components.

4. The system of claim 1 including means for equalizing said simulated sum and difference signals so as to provide said signals with physiological hearing characteristics that modify apparent direction of received sound.

5. The system of claim 4 wherein said means for equalizing comprises first means for boosting relative amplitudes of components of said simulated sum signal in a mid-range of frequencies, and second means for boosting relative amplitudes of components of said simulated difference signal in higher and lower frequencies outside of said mid-range.

6. The system of claim 5 wherein said mid-range extends from about one to four Kilohertz, wherein said higher frequencies extend from about four to ten Kilohertz, and wherein said low frequencies extend from about two hundred to five hundred Hertz.

7. The system of claim 1 including means for inverting a selected frequency band of said simulated difference signal, means for combining signals in such inverted frequency band with signals in bands of frequencies of said simulated difference signal other than said selected band, thereby providing an enhanced simulated difference signal, said simulated sum signal and said enhanced simulated difference signal comprising inputs to said stereo image enhancing circuit means.

8. The system of claim 1 wherein said stereo image enhancing circuit means comprises means for selectively altering relative amplitudes of components of said simulated difference signal within respective predetermined frequency bands so as to boost difference signal components in relatively quieter difference signal frequency bands and for selectively altering relative amplitudes of components of said simulated sum signal within said respective predetermined frequency bands.

9. The system of claim 1 wherein said stereo image enhancement circuit means comprises means for selectively boosting relative amplitudes of components of said simulated difference signal so as to boost selected simulated difference signal components in relatively quieter difference signal frequency bands to provide a processed difference signal and for selectively altering the relative amplitudes of components of said simulated sum signal so as to attenuate selected simulated sum signal components in said relatively quieter difference signal frequency bands relative to other simulated sum signal components to provide a processed sum signal, and means responsive to said processed sum and difference signals to provide processed left and right stereo output signals.

10. The method of deriving stereo enhanced signals from a monaural input signal comprising the steps of:

generating a simulated sum signal from said input signal by shifting the phase of said input signal by an amount that is substantially constant over a broad band of frequencies, generating from said input signal a simulated difference signal that is delayed with respect to said simulated sum signal and which includes components of different frequencies each having a delay relative to a component of like frequency of said simulated sum signal that is different than the delay of another frequency component of said difference signal relative to another frequency component of like frequency of said simulated sum signal said step of generating a simulated difference signal comprising shifting the phase of said input signal by an amount that delays said simulated difference signal by about 90° relative to said simulated sum signal, equalizing said simulated sum and difference signals to provide stereo image enhanced stereo signals, and generating left and right stereo output signals from said stereo signals.

11. The method of claim 10 wherein said step of generating a simulated sum signal comprises delaying different frequency components of said input signal by amounts related to the frequency thereof to provide a simulated sum signal having an overall delay relative to said input signal.

12. The method of claim 11 wherein said steps of generating simulated sum and difference signals comprise the step of subjecting said input signal to first and second phase shifts that are each constant over a broad frequency band.

13. The method of claim 12 wherein said step of equalizing comprises boosting amplitudes of components of said simulated difference signal in relatively quieter difference signal frequency bands, and attenuating amplitudes of components of said input signal in said frequency bands.

14. A system for generating stereo output signals from a monaural input signal, said system comprising:

first phase shift means responsive to the input signal for generating a simulated sum signal, second phase shift means responsive to the input signal for generating a simulated difference signal, and stereo image enhancement means responsive to said simulated sum and difference signals for generating stereo enhanced left and right output signals, said stereo image enhancing means comprising:

means for selectively altering relative amplitudes of components of said simulated difference signal within respective predetermined frequency bands so as to boost difference signal components in relatively quieter difference signal frequency bands, said first and second phase shift comprising a constant phase shift circuit having first phase shift channel means responsive to said input signal for generating said synthetic sum signal with a phase that is shifted relative to phase of said input signal, and having second phase shift channel means responsive to said input signal for generating said synthetic difference signal with a phase that lags the phase of said synthetic sum signal by about 90° over said predetermined frequency bands, and means for selectively altering relative amplitudes of components of said input signal within said respective predetermined frequency bands.

15. The system of claim 14 including input means for receiving a stereo input including first sum and difference signals representing respectively the sum of and difference between left and right stereo signals, said input means including means for providing said first sum signal as said input signal, and switching means for connecting to said enhancement means either (a) a first pair of signals comprising said simulated sum and difference signals or (b) a second pair of signals comprising said first sum and difference signals.

16. The system of claim 15 including sensing means responsive to said first difference signal for operating said switching means to transmit to said enhancement means signals comprising primarily said first pair when said first difference signal is relatively weaker and to transmit to said enhancement means signals comprising primarily said second pair when said first difference signal is relatively stronger.

17. The system of claim 14 wherein said means for generating a simulated difference signal comprises means for generating a simulated signal delayed relative to said simulated sum signal and having components of different frequencies, each having a different time delay relative to corresponding components of like frequencies of said simulated sum signal.

18. The system of claim 14 wherein said means for generating a simulated difference signal comprises means for shifting the phase of said input signal with a phase shift that is constant over a broad frequency range so that different frequency components of said simulated difference signal lag corresponding frequency components of said simulated sum signal by different amounts.

19. The system of claim 1 wherein said phase shift means comprises a constant phase shift circuit having first phase shift channel means responsive to said input signal for generating said synthetic sum signal with a phase that is shifted relative to the phase of said input signal, and having second phase shift channel means responsive to said input signal for generating said synthetic difference signal with a phase that lags the phase of said synthetic sum signal by about 90° over said predetermined frequency bands.

* * * * *